US010620574B2

(12) United States Patent
Kitano et al.

(10) Patent No.: US 10,620,574 B2
(45) Date of Patent: Apr. 14, 2020

(54) FIXING MEMBER AND HEAT FIXING APPARATUS

(71) Applicant: CANON KABUSHIKI KAISHA, Tokyo (JP)

(72) Inventors: Yuji Kitano, Tokyo (JP); Katsuya Abe, Tokyo (JP); Takeshi Suzuki, Yokohama (JP); Mamo Matsumoto, Hiratsuka (JP); Matsutaka Maeda, Kawasaki (JP); Yasuharu Notoya, Tokyo (JP); Katsuhisa Matsunaka, Inagi (JP); Masaaki Takahashi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/425,085

(22) Filed: May 29, 2019

(65) Prior Publication Data

US 2019/0377290 A1 Dec. 12, 2019

(30) Foreign Application Priority Data

Jun. 7, 2018 (JP) ..... 2018-109672

(51) Int. Cl.
*G03G 15/20* (2006.01)

(52) U.S. Cl.
CPC ..... *G03G 15/2057* (2013.01)

(58) Field of Classification Search
CPC ..... G03G 15/2057; G03G 2215/2022; G03G 2215/2035; G03G 2215/2045; G03G 2215/2054
See application file for complete search history.

(56) References Cited

U.S. PATENT DOCUMENTS 7,457,577 B2 11/2008 Matsunaka et al.
7,979,015 B2 7/2011 Matsunaka et al.
8,005,413 B2 * 8/2011 Sakakibara ..... G03G 15/206 399/331

(Continued)

FOREIGN PATENT DOCUMENTS

JP 2006-259712 A 9/2006
JP 2014-142611 A 8/2014

(Continued)

OTHER PUBLICATIONS

Extended European Search Report in European Application No. 19178312.5 (dated Jan. 2020).

*Primary Examiner* — Francis C Gray
(74) *Attorney, Agent, or Firm* — Venable LLP

(57) ABSTRACT

Provided is a fixing member for a heat fixing apparatus which can further improve utilization efficiency of heat for heat fixing of an unfixed toner. A fixing member having an endless belt shape includes a substrate and an elastic layer on the substrate, wherein the elastic layer includes silicone rubber and a filler dispersed in the silicone rubber, and when a thermal conductivity of the elastic layer in a thickness direction is defined as λnd, a thermal conductivity of the elastic layer in a circumferential direction is defined as λtd, and a thermal conductivity of the elastic layer in a width direction is defined as λmd, λnd is 1.30 W/(m·K) or more, and λnd, λtd, and λmd satisfy a relationship as shown below λnd>λmd>λtd.

11 Claims, 6 Drawing Sheets

(56) References Cited

U.S. PATENT DOCUMENTS

| | | | | |
|---|---|---|---|---|
| 8,224,223 | B2 | 7/2012 | Sakakibara et al. | |
| 8,369,763 | B2 | 2/2013 | Sakakibara et al. | |
| 8,626,046 | B2 | 1/2014 | Sekihara et al. | |
| 8,688,023 | B2 * | 4/2014 | Sekihara | G03G 15/206 399/333 |
| 9,086,664 | B2 | 7/2015 | Matsunaka et al. | |
| 9,134,663 | B2 | 9/2015 | Matsunaka et al. | |
| 9,176,442 | B2 | 11/2015 | Nakayama et al. | |
| 9,268,273 | B2 * | 2/2016 | Miyahara | G03G 15/206 |
| 9,367,009 | B2 | 6/2016 | Akiyama et al. | |
| 10,228,644 | B2 | 3/2019 | Abe et al. | |
| 2006/0188300 | A1 * | 8/2006 | Matsunaka | G03G 15/2053 399/333 |
| 2008/0219729 | A1 * | 9/2008 | Matsunaka | G03G 15/2053 399/330 |
| 2009/0003902 | A1 * | 1/2009 | Sakakibara | G03G 15/206 399/331 |
| 2014/0255067 | A1 * | 9/2014 | Matsunaka | G03G 15/2057 399/333 |
| 2014/0301762 | A1 * | 10/2014 | Inoue | G03G 15/2057 399/333 |
| 2014/0301763 | A1 * | 10/2014 | Miura | G03G 15/206 399/333 |
| 2015/0147101 | A1 * | 5/2015 | Nakayama | G03G 15/2057 399/329 |
| 2015/0160596 | A1 * | 6/2015 | Asaka | G03G 15/206 399/333 |
| 2016/0018766 | A1 * | 1/2016 | Akiyama | G03G 15/206 399/333 |
| 2016/0018767 | A1 * | 1/2016 | Takada | G03G 15/206 399/333 |

FOREIGN PATENT DOCUMENTS

| | | | |
|---|---|---|---|
| JP | 2015-102618 | A | 6/2015 |
| JP | 2015-118327 | A | 6/2015 |
| JP | 2015-121650 | A | 7/2015 |
| JP | 2015-127791 | A | 7/2015 |
| JP | 2017-037152 | A | 2/2017 |

* cited by examiner

FIXING MEMBER AND HEAT FIXING APPARATUS

BACKGROUND OF THE INVENTION

Field of the Invention

The present disclosure relates to a fixing member used for a heat fixing apparatus of an electrophotographic image forming apparatus and a heat fixing apparatus.

Description of the Related Art

In the heat fixing apparatus of an electrophotographic image forming apparatus, a pressure contact portion is constituted by a heating member and a pressure member disposed opposite to the heating member. When a recorded material holding an unfixed toner image is introduced to the pressure contact portion, an unfixed toner is heated and pressed, the toner is melted, and the image is fixed on the recorded material. The heating member is a member in contact with the unfixed toner image on the recorded material, and the pressure member is a member disposed opposite to the heating member. The fixing member according to the present disclosure includes a heating member and a pressure member. There is a rotatable member having a roller shape or an endless belt shape as a shape of the fixing member. As these fixing members, fixing members having an elastic layer containing, for example, a rubber such as a crosslinked silicone rubber and a filler on a substrate made of metal or a heat-resistant resin are used.

In recent years, from the viewpoint of energy saving, it is required to further improve utilization efficiency of heat at the time of thermally fixing the unfixed toner. Japanese Patent Application Laid-Open No. 2006-259712 discloses a heat fixing member in which an elastic layer includes an elastic material, and a carbon fiber dispersed in the elastic material, and an orientation inhibiting component. In this heat fixing member, the orientation of the carbon fiber in a surface direction of the elastic layer is inhibited by the orientation inhibiting component, and thermal conductivity of the elastic layer in the thickness direction is 1.0 W/(m·K) or more.

SUMMARY OF THE INVENTION

An aspect of the present disclosure is directed to providing a fixing member for a heat fixing apparatus capable of further improving utilization efficiency of heat for heat-fixing an unfixed toner. In addition, another aspect of the present disclosure is directed to providing a heat fixing apparatus which contributes to a more efficient formation of an electrophotographic image.

According to an aspect of the disclosure, there is provided a fixing member having an endless belt shape includes a substrate and an elastic layer on the substrate, the elastic layer includes silicone rubber and a filler dispersed in the silicone rubber, when a thermal conductivity of the elastic layer in a thickness direction is expressed as λnd, a thermal conductivity of the elastic layer in a circumferential direction is expressed as λtd, and a thermal conductivity of the elastic layer in a width direction is defined as λmd, λnd is 1.30 W/(m·K) or more, and λnd, λtd, and λmd satisfy a relationship shown by the following Expression (a).

$$\lambda nd > \lambda md > \lambda td \qquad \text{Expression (a)}$$

In addition, according to another aspect of the present disclosure, there is provided a heat fixing apparatus includes: a heating member; and a pressure member disposed opposite to the heating member, wherein the heating member is the fixing member.

Further features of the present disclosure will become apparent from the following description of exemplary embodiments with reference to the attached drawings.

DESCRIPTION OF THE EMBODIMENTS

According to the study of the present inventors, the heat fixing member according to Japanese Patent Application Laid-Open No. 2006-259712 can improve a thermal conductivity of an elastic layer in a thickness direction. However, since the thermal conductivity of the elastic layer in an in-plane direction is higher than the thermal conductivity of the elastic layer in the thickness direction, the heat of the heat fixing member is diffused in the in-plane direction of the elastic layer and thus it was not effectively used for heat-fixing an unfixed toner on a recorded material. Therefore, as a result of further studies, the present inventors have newly found a configuration of an elastic layer capable of efficiently supplying heat to the unfixed toner on the recorded material.

Figure 1:
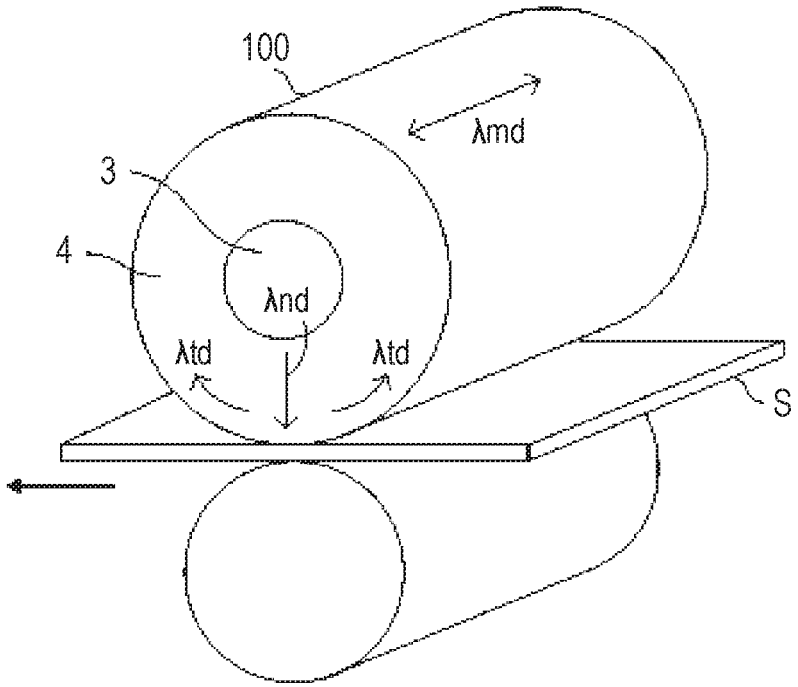
FIG. 1 is a conceptual diagram for describing a thermal conduction direction of a fixing member according to an embodiment of the present disclosure.

As shown in FIG. 1, when a thermal conductivity of an elastic layer 4 of an endless belt-shaped fixing member 100 abutting on a recorded material S in the thickness direction is defined as λnd, a thermal conductivity of the elastic layer in a circumferential direction is defined as λtd, and a thermal conductivity of the elastic layer in a direction orthogonal to the circumferential direction, that is, in a width direction is defined as λmd, λnd, λtd, and λmd satisfy a relationship represented by the following Expression (a), such that heat applied to the fixing member is preferentially transmitted in a thickness direction rather than an in-plane direction of an elastic layer.

$$\lambda nd > \lambda md > \lambda td \qquad \text{Expression (a)}$$

As a result, the heat of the fixing member 100 can be transmitted to the recorded material S and the unfixed toner on the recorded material S more efficiently. Hereinafter, an embodiment of the present disclosure will be described in detail with reference to the drawings.

(1) Outline of Configuration of Fixing Member

A fixing member according to an aspect of the present disclosure can be, for example, rotatable members (hereinafter, also referred to as a "fixing roller" and a "fixing belt", respectively) having a shape such as a roller shape or an endless belt shape.

Figure 2B:
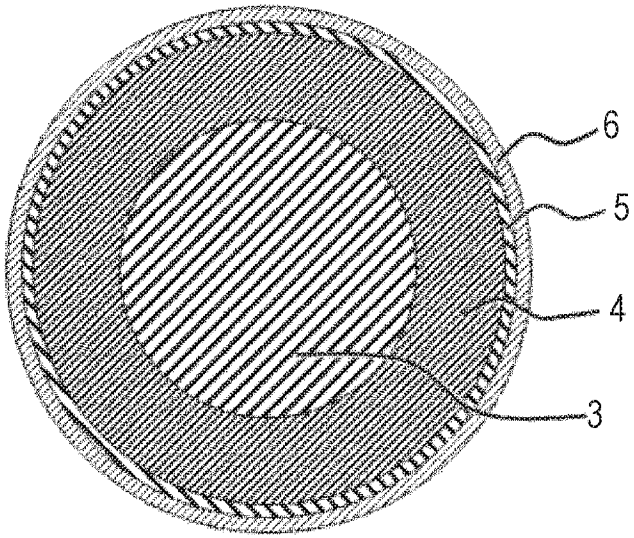
FIG. 2B is a schematic cross-sectional view of a fixing member according to an embodiment in a form of a roller.
Figure 2A:
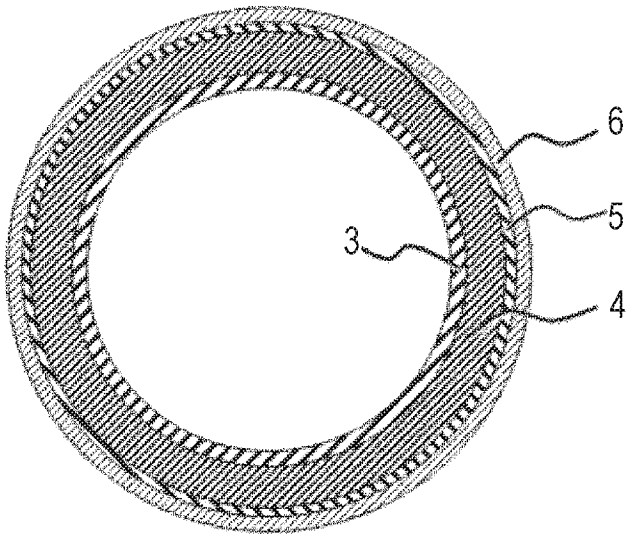
FIG. 2A is a schematic cross-sectional view of a fixing member according to an embodiment in a form of a belt.

FIG. 2A is a cross-sectional view of a fixing belt in a circumferential direction, and FIG. 2B is a cross-sectional view of a fixing roller in a circumferential direction. As shown in FIGS. 2A and 2B, the fixing member has a substrate 3, an elastic layer 4 containing silicone rubber on an outer surface of the substrate 3, and a surface layer 6 on an outer surface of the elastic layer. In addition, an adhesive layer 5 may be provided between the elastic layer 4 and the surface layer 6, and in this case, the surface layer 6 is fixed to an outer peripheral surface of the elastic layer 4 by an adhesive layer 5.

(2) Substrate

A material of a substrate is not particularly limited, and materials known in the field of a fixing member can be used as appropriate. Examples of the materials constituting the substrate include metals such as aluminum, iron, nickel and copper, alloys such as stainless steel, resins such as polyimide and the like.

Here, when a heat fixing apparatus is a heat fixing apparatus which heats the substrate by an induction heating type as a heating unit of the fixing member, the substrate is made of at least one metal selected from the group consisting of nickel, copper, iron, and aluminum. Among them, in particular, from the viewpoint of heat generation efficiency, an alloy containing nickel or iron as a main component is preferably used. In addition, the main component means the most contained component, among components which constitute a target (here, a substrate).

The shape of the substrate can be appropriately selected according to the shape of the fixing member, and can be various shapes such as an endless belt shape, a hollow cylindrical shape, a solid cylindrical shape, and a film shape. In the case of a fixing belt, a thickness of the substrate is preferably, for example, 15 to 80 λm. By setting the thickness of the substrate within the above range, strength and flexibility can be compatible at a high level.

In addition, for example, a layer for preventing abrasion of an inner peripheral surface of the fixing belt when the inner peripheral surface of the fixing belt contacts other members or a layer for improving slidability with other members can be provided on a surface of an opposite side to a side facing the elastic layer of the substrate.

(3) Elastic Layer

An elastic layer contains silicone rubber as a binder and a filler dispersed in the silicone rubber. In addition, when a thermal conductivity of the elastic layer in a thickness direction is defined as λnd, a thermal conductivity of the elastic layer in a circumferential direction is defined as λtd, and a thermal conductivity of the elastic layer in the direction orthogonal to the circumferential direction, that is, a thermal conductivity in a width direction is defined as λmd, λnd, λtd, and λmd satisfy the relationship shown in the following Expression (a), and λnd is 1.30 W/(m·K) or more.

$$\lambda nd > \lambda md > \lambda td \qquad \text{Expression (a)}$$

The thermal conductivity λnd of the elastic layer in the thickness direction is higher than the thermal conductivity (λnd, λtd) of the elastic layer in the in-plane direction, and λnd is 1.30 W/(m·K) or more, such that heat easily flows in the thickness direction of the elastic layer and heat does not easily escape in the in-plane direction. Therefore, heat can be efficiently supplied to the recorded material and the toner at a fixing nip. λnd is preferably 1.40 W/(m·K) or more from the viewpoint of further effective use of heat. In addition, it is preferable that λnd and λtd satisfy the relationship of Expression (b): λnd×0.9≥λtd. Accordingly, heat can be supplied more efficiently.

The thermal conductivity λnd of the elastic layer in the thickness direction can be calculated from the following Equation (2).

$$\lambda nd = \alpha_{nd} \times C_p \times \rho \qquad \text{Equation (2)}$$

In the Equation (2), λnd is the thermal conductivity (W/(m·K)) of the elastic layer in the thickness direction, and is the thermal diffusivity ($m^2/s$) in the thickness direction, $C_p$ is a constant pressure specific heat (J/(kg)·K)), and ρ is a density ($kg/m^3$).

In addition, the thermal conductivity λmd of the elastic layer in the width direction and the thermal conductivity λtd of the elastic layer in the circumferential direction can be calculated from the following Equations (3) and (4).

$$\lambda td = \alpha_{md} \times C_p \times \rho \qquad \text{Equation (3)}$$

$$\lambda td = \alpha_{td} \times C_p \times \rho \qquad \text{Equation (4)}$$

In the Equations (3) and (4), $\alpha_{md}$ is a thermal diffusivity ($m^2/s$) in the width direction, $\alpha_{td}$ is the thermal diffusivity ($m^2/s$) in the circumferential direction, $C_p$ is the constant pressure specific heat (J/(kd·K)), and ρ is the density ($kg/m^3$). In addition, a measurement method of each parameter is explained in detail with reference to Example.

The above-mentioned thermal properties according to this aspect can be achieved, for example, by the elastic layer formed by arranging fillers in the thickness direction. Such an elastic layer can be produced, for example, by the following method. A layer (hereinafter, also referred to as a "composition layer") of a composition for forming the elastic layer containing a thermally conductive filler and a raw material of a binder is formed on the substrate. Before thermally curing the composition layer, an outer surface of the composition layer is charged. Thereby, it is considered that the fillers in the composition layer are dielectrically polarized and arranged in the thickness direction. As a result, the elastic layer having λnd larger than λtd and λmd can be produced. A method for charging the outer surface of the composition layer will be described later.

(3-1) Silicone Rubber

When a fixing member is used as a heating member, an elastic layer containing silicone rubber functions as a layer providing excellent flexibility for following up unevenness of paper at the time of fixing. In addition, when the fixing member is used as a pressure member, the elastic layer functions as a layer for providing flexibility for securing the fixing nip. Since the silicone rubber has high heat resistance capable of maintaining flexibility even in the environment where a temperature reaches a high temperature of about 240° C. in a non-paper passing region, the silicone rubber is particularly suitably used as a binder for the elastic layer. As the silicone rubber, for example, a cured product (hereinafter, also referred to as "cured silicone rubber") of an addition-curable liquid silicone rubber described below can be used.

(3-1-1) Addition-Curable Liquid Silicone Rubber

The addition-curable liquid silicone rubber usually contains the following Components (a) to (c):

Component (a): organopolysiloxane having an unsaturated aliphatic group;

Component (b): organopolysiloxane having active hydrogen bonded to silicon; and

Component (c): catalyst.

Hereinafter, each component will be described.

(3-1-2) Component (a)

As the organopolysiloxane having the unsaturated aliphatic group, any organopolysiloxane having an unsaturated aliphatic group such as a vinyl group can be used. For example, compounds represented by the following Structural Formula 1 and Structural Formula 2 can be used as the Component (a).

A linear organopolysiloxane which has any one or both selected from the group consisting of an intermediate unit represented by $R_1R_1SiO$ and an intermediate unit represented by $R_1R_1SiO$, and a molecule terminal represented by $R_1R_1R_2SiO_{1/2}$ (see Structural Formula 1 below).

Structural Formula 1

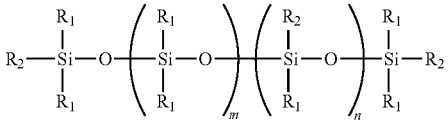

A linear organopolysiloxane which has any one or both selected from the group consisting of an intermediate unit represented by $R_1R_1SiO$ and an intermediate unit represented by $R_1R_2SiO$, and a molecule terminal represented by $R_1R_1R_1SiO_{1/2}$ (see Structural Formula 2 below).

Structural Formula 2

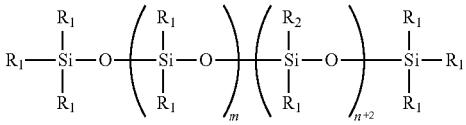

In Structural Formula 1 and Structural Formula 2, $R_1$ each independently represents an unsubstituted hydrocarbon group not containing an unsaturated aliphatic group, $R_2$ each independently represents an unsaturated aliphatic group, m and n each independently represent an integer of 0 or more.

Examples of the unsubstituted hydrocarbon group not containing the unsaturated aliphatic group represented by $R_1$ in Structural Formula 1 and Structural Formula 2 may include alkyl groups such as a methyl group, an ethyl group, and a propyl group. Among them, $R_1$ is preferably a methyl group.

In addition, in Structural Formula 1 and Structural Formula 2, examples of the unsaturated aliphatic group represented by $R_2$ can include a vinyl group, an allyl group, a 3-butenyl group and the like, but $R_2$ is preferably a vinyl group.

The linear organopolysiloxane having n=0 in Structural Formula 1 has an unsaturated aliphatic group only at both terminals thereof, and the linear organopolysiloxane having n=1 or more has an unsaturated aliphatic group at both terminals and a side chain thereof. In addition, the linear organopolysiloxane represented by Structural Formula 2 has an unsaturated aliphatic group only at the side chain thereof. As the Component (a), one type may be used alone, or two or more types may be used in combination.

In addition, from the viewpoint of moldability, a viscosity of the Component (a) is preferably 100 $mm^2/s$ or more and 50000 $mm^2/s$ or less. The viscosity (kinematic viscosity) can be measured using a capillary viscometer, a rotational viscometer or the like based on Japanese Industrial Standard (hereinafter, referred as "JIS") Z 8803:2011. In addition, in the case of using a commercial item as a Component (a), a catalog value can be referred.

(3-1-3) Component (b)

The organopolysiloxane having active hydrogen bonded to silicon is a crosslinking agent which forms a crosslinked structure by reaction with the unsaturated aliphatic group in the Component (a) by a catalytic action of a platinum compound or the like.

As the Component (b), any organopolysiloxane having a Si—H bond can be used, but, for example, those satisfying the following conditions can be suitably used. As the Component (b), one type may be used alone, or two or more types may be used in combination.

From the viewpoint of the formation of the crosslinked structure by reaction with the organopolysiloxane having the unsaturated aliphatic group, the number of hydrogen atoms bonded to silicon atoms in one molecule is 3 or more on average.

Although an example in which an organic group bonded to the silicon atom is, for example, the unsubstituted hydrocarbon group as described above is described, it is preferable that this organic group is a methyl group.

A siloxane skeleton (—Si—O—Si—) may be any one of a linear type, a branched type, or a cyclic type.

The Si—H bond may be present in any siloxane unit in the molecule.

As the Component (b), for example, linear organopolysiloxane represented by the following Structural Formula 3 and Structural Formula 4 can be used.

Structural Formula 3

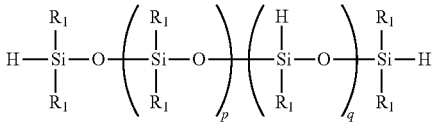

Structural Formula 4

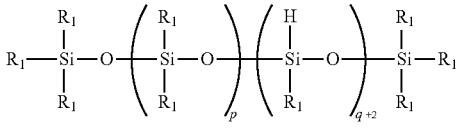

In Structural Formula 3 and Structural Formula 4, $R_1$ each independently represents an unsubstituted hydrocarbon group not containing an unsaturated aliphatic group, p represents an integer of 0 or more, and q represents an integer of 1 or more. As described above, $R_1$ is the unsubstituted hydrocarbon group not containing the unsaturated aliphatic group, but is preferably a methyl group.

(3-1-4) Component (c)

As a hydrosilylation (addition curing) catalyst, for example, a platinum compound can be used. Specifically, a platinum carbonyl cyclovinyl methyl siloxane complex, a 1,3-divinyl tetramethyl disiloxane platinum complex and the like can be mentioned.

(3-2) Filler

As the filler, as described above, when the outer surface of the composition layer is charged, those which generate a dielectric polarization in the composition layer, are arranged in the composition layer, and have high thermal conductivity are preferably used. Examples of such fillers include silicon carbide, silicon nitride, boron nitride, aluminum nitride, alumina, zinc oxide, magnesium oxide, silica, copper, aluminum, silver, iron, nickel, metallic silicon, carbon fiber, and the like. Among them, from the viewpoint of thermal conductivity and an electrical resistance value, at least one filler selected from the group consisting of alumina, zinc oxide, metallic silicon, silicon carbide, and magnesium oxide is preferably used. Magnesium oxide having a particularly high electrical resistance value is particularly preferably used.

In terms of a blending amount of the filler in the elastic layer, it is preferable to set a ratio of a total volume of the filler to a volume of the elastic layer to be 30% or more and 60% or less. By setting a volume ratio of the filler to be 30% or more, the high thermal conductivity of the elastic layer can be expected, and by setting the volume ratio to be 60% or less, the flexibility of the elastic layer can be secured. More preferably, sufficient rubber elasticity can be exhibited by setting the volume ratio of the filler to be 30% or more and 50% or less.

(3-3)

An elastic modulus of the elastic layer containing the silicone rubber can be adjusted by a type or a blending amount of the Component (a), a type or a blending amount of the Component (b), and a type or a blending amount of the Component (c), and furthermore, a type or a blending amount of a curing retarder as an option. The elastic layer containing the silicone rubber more preferably has a (tensile) elastic modulus of 0.20 MPa or more and 1.20 MPa or less. If the elastic modulus of the elastic layer is within this range, the elastic layer becomes a low hardness (soft) elastic layer, and a high quality image can be obtained.

The elastic modulus and the hardness of the elastic layer have a gentle correlation, and the elastic layer having the elastic modulus within the above range has an Asker C hardness (JIS K7312-1996) of about 60° or less and has excellent flexibility. If the elastic modulus is less than 0.20 MPa, depending on the configuration of the heat fixing apparatus, the rubber may be broken or plastically deformed when repeatedly compressed in a high temperature state.

The elastic modulus (tensile modulus) of the elastic layer can be measured, for example, as follows. A sample piece is cut out from the elastic layer by a punching die (JIS K6251:2017 tensile dumbbell-shaped 8), and a thickness in the vicinity of the center which is the measurement location is measured. Next, the cut-out sample pieces were tested at a tensile speed of 200 mm/min and a room temperature using a tensile tester (apparatus name: Strograph EII-L1, manufactured by Toyo Seiki Seisaku-sho, Ltd.). The tensile elastic modulus is indicated by a slope when measurement data are linearly approximated within the range in which the strain is 0 to 10% by creating a graph in which a strain of a sample piece is indicated on an abscissa and a tensile stress is indicated on an ordinate based on the measurement results.

The composition of the silicone rubber contained in the elastic layer can be confirmed by performing total reflection (ATR) measurement using an infrared spectral analyzer (FT-IR) (for example, trade name: Frontier FT IR, manufactured by PerkinElmer Inc.). A silicon-oxygen bond (Si—O), which is a main chain structure of silicone rubber, exhibits strong infrared absorption in the vicinity of a wave number of 1020 $cm^{-1}$ accompanied by stretching vibration. In addition, the presence of a methyl group (Si—$CH_3$) bonded to a silicon atom can be confirmed by strong infrared absorption in the vicinity of a wave number of 1260 $cm^{-1}$ accompanied by bending vibration caused by the structure.

A content of the cured silicone rubber and the filler in the elastic layer can be confirmed by using a thermogravimetric apparatus (TGA) (for example, trade name: TGA851, manufactured by Mettler Toledo). Specifically, the elastic layer is cut out with a razor or the like, and the cut-out elastic layer is accurately weighed to about 20 mg, and put into the alumina pan used in the apparatus. The alumina pan into which a sample is put is set in the apparatus and heated at a temperature raising rate of 20° C. per minute from a room temperature to 800° C. under a nitrogen atmosphere and furthermore, is fixed at a temperature of 800° C. for 1 hour. Since the cured silicone rubber component is not oxidized but is decomposed and removed by cracking as the temperature rises under the nitrogen atmosphere, the weight of the sample is decreased. By doing so, the content of the cured silicone rubber component contained in the elastic layer or the content of the filler can be confirmed by comparing the weights before and after the measurement.

(4) Adhesive Layer

An adhesive layer is a layer for adhering the elastic layer and the surface layer. An adhesive used for the adhesive layer can be appropriately selected from known ones, and is not particularly limited. However, from the viewpoint of easy handling, it is preferable to use an addition-curable silicone rubber blended with a self-adhesive component. This adhesive can contain, for example, a self-adhesive component, an organopolysiloxane in which a plurality of unsaturated aliphatic groups which are represented by a vinyl group are in a molecular chain, a hydrogen organopolysiloxane, and a platinum compound as a crosslinking catalyst. It is possible to form an adhesive layer for adhering the surface layer to the elastic layer by curing the adhesive applied to the surface of the elastic layer by an addition reaction.

In addition, as the self-adhesive component, for example, the following can be mentioned.

Silane having at least one, preferably two or more functional groups selected from the group consisting of an alkenyl group such as a vinyl group, a (meth)acryloxy group, a hydrosilyl group (SiH group), an epoxy group, an alkoxysilyl group, a carbonyl group, and a phenyl group.

Organosilicon compound such as cyclic or linear siloxane having from 2 to 30 silicon atoms, and preferably from 4 to 20 silicon atoms.

Non-silicon-based (that is, containing no silicon atom in the molecule) organic compound which may also contain an oxygen atom in the molecule. However, one or more and four or less, preferably one or more and two or less aromatic rings such as a phenylene structure having 1 valence or more and 4 valences or less, preferably 2 valences or more and 4 valences or less are contained in one molecule. Further, at least one, preferably two or more and four or less functional groups (for example, an alkenyl group, a (meth)acryloxy group) which can contribute to the hydrosilylation addition reaction is contained in one molecule.

The self-adhesive component may be used alone or two or more in combination. In addition, a filler component can be added to the adhesive in the range conforming to the purpose of the present disclosure from the viewpoint of controlling viscosity and securing heat resistance. As the filler component, for example, the following can be mentioned.

Silica, alumina, iron oxide, cerium oxide, cerium hydroxide, carbon black and the like.

The blending amount of each component contained in the adhesive is not specifically limited, but may be appropriately set. Such an addition-curable silicone rubber adhesive are also commercially available and readily available. The thickness of the adhesive layer is preferably 20 μm or less. When the fixing belt according to this aspect is used in the heat fixing apparatus as a heating belt, the thermal resistance can be easily set small, and heat from the inner surface side can be efficiently transmitted to a recording medium by setting the thickness of the adhesive layer to be 20 μm or less.

(5) Surface Layer

A surface layer as an option preferably contains a fluororesin in order to exhibit a function as a release layer for preventing adhesion of a toner to an outer surface of a fixing member. For forming the surface layer, for example, ones obtained by molding the resin exemplified below in a tube shape can be used.

Tetrafluoroethylene-perfluoro (alkyl vinyl ether) copolymer (PFA), polytetrafluoroethylene (PTFE), tetrafluoroethylene-hexafluoropropylene copolymer (FEP).

Among the above exemplified resin materials, the PFA is preferably used for the surface layer from the viewpoint of moldability and toner releasability.

A thickness of the surface layer is preferably 10 μm or more and 50 μm or less. By setting the thickness of the surface layer to be in this range, it is easy to maintain an appropriate surface hardness of the fixing member.

(6) Method for Producing Fixing Member

The fixing member according to this aspect can be produced, for example, by a producing method including the following steps.

(i) a step of forming an elastic layer on a substrate using a composition containing at least a filler and a raw material of a binder (step of forming an elastic layer).

In addition, the manufacturing method can include the following steps.

(ii) a step of preparing a substrate;

(iii) a step of forming an adhesive layer on the elastic layer.

(iv) a step of forming a surface layer on the elastic layer.

The above step (i) can have the following processes.

(i-1) Step of preparing a composition for the elastic layer containing a filler and a raw material of a binder (step of preparing a composition for an elastic layer).

(i-2) Step of forming a layer containing the composition on a substrate (step of forming a composition layer).

(i-3) Step of setting a thermally conductive filler in the composition layer to a predetermined orientation state (step of orienting the thermally conductive filler).

(i-4) Step of curing the composition layer in which the thermally conductive filler is in a predetermined orientation state to form the elastic layer (curing step).

The above steps (i-2) to (i-4) may be performed sequentially or in parallel. Hereinafter, each step will be described in detail.

(ii) Step of Preparing Substrate

First, the substrate made of the above-described material is prepared. The shape of the substrate can be appropriately set as described above, and can have, for example, an endless belt shape. A layer for imparting various functions such as heat insulation to the fixing belt can be appropriately formed on the inner surface of the substrate, and surface treatment can also be performed on the outer surface of the substrate to impart various functions such as adhesiveness to the fixing member.

(i) Step of Forming Elastic Layer (i-1) Step of Preparing Composition for Elastic Layer First, a composition for an elastic layer which contains a filler and an addition-curable liquid silicone rubber is prepared.

(i-2) Step of Forming Composition Layer

The composition is applied on a substrate by methods such as a metallic molding method, a blade coating method, a nozzle coating method, and a ring coating method to form a layer of the composition.

(i-3) Step of Orienting Thermally Conductive Filler

As an embodiment of arranging the thermally conductive fillers in the composition layer formed in the step (i-2) in the thickness direction, a method of corona charging the outer surface of the composition layer using a corona charger will be described. The corona charging method includes a scorotron method having a grid electrode between a corona wire and a member to be charged and a corotron method not having a grid electrode, but from the viewpoint of controllability of a surface potential of the member to be charged, the scorotron method is preferable.

Figure 3B:
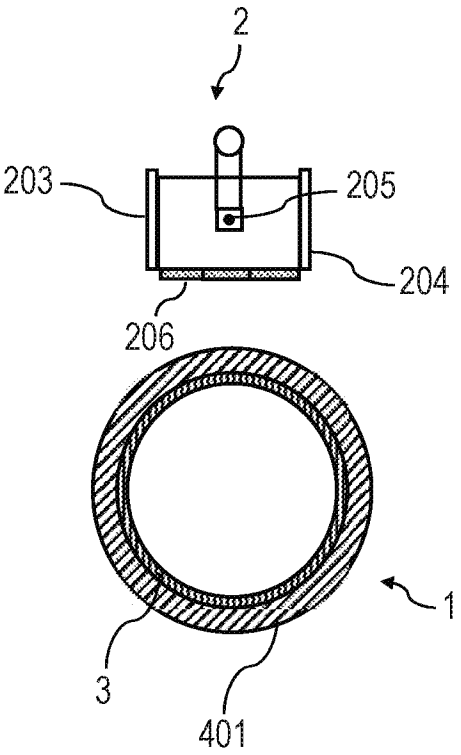
FIG. 3B is a cross-sectional view when the fixing member according to the embodiment of the present disclosure is charged by a corona charger.
Figure 3A:
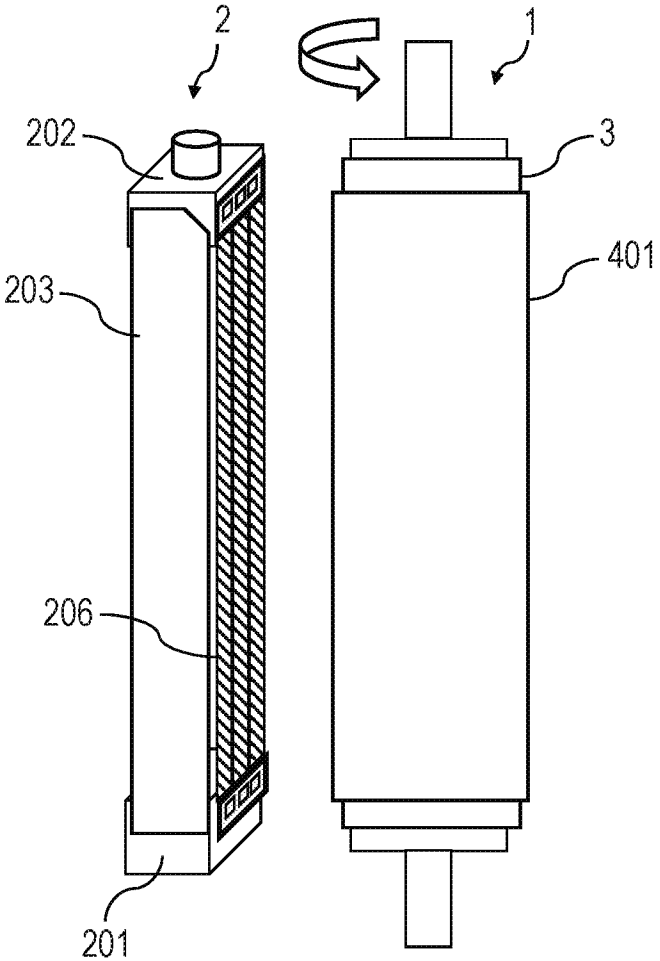
FIG. 3A is a bird's-eye view when the fixing member according to the embodiment of the present disclosure is charged by a corona charger.

As shown in FIGS. 3A and 3B, the corona charger 2 includes blocks 201 and 202, shields 203 and 204, and a grid 206. In addition, a discharge wire 205 is stretched between the block 201 and the block 202.

A high voltage is applied to the discharge wire 205 by a high voltage power supply (not shown) and an ion flow obtained by a discharge to the shields 203 and 204 is controlled by applying a high voltage to the grid 206, such that a surface of a composition layer 401 is charged. At this time, since a substrate 3 or a core 1 holding the substrate 3 are grounded (not shown), it is possible to generate a desired electric field on the composition layer by controlling a surface potential of the surface of the composition layer 401.

Accordingly, a potential gradient is generated in the circumferential direction of the composition layer by an attenuation of the surface potential, and an anisotropy is generated in the arrangement of the fillers in the elastic layer surface due to the anisotropy of the electric field applied to the elastic layer, such that the electric layer satisfying the relationship of $\lambda nd>\lambda md>\lambda td$ can be produced.

Materials such as stainless steel, nickel, molybdenum, and tungsten can be appropriately used for the discharge wire 205, but it is preferable to use tungsten which is very stable among metals. A shape of the discharge wire 205 stretched inside the shields 203 and 204 is not particularly limited, but for example, one having a shape like a saw tooth or one (circular cross-sectional shape) in which a cross-sectional shape when the discharge wire is vertically cut is circular can be used. A diameter of the discharge wire 205 (in a cut surface when the discharge wire is vertically cut to the wire) is preferably 40 μm or more and 100 μm or less. If the diameter of the discharge wire 205 is 40 μm or more, it is possible to easily prevent the discharge wire from being cut or broken due to the collision of ions by the discharge. In addition, if the diameter of the discharge wire 205 is 100 μm or less, an appropriate applied voltage can be applied to the discharge wire 205 to obtain a stable corona discharge, and ozone can be easily prevented from being generated. As shown in FIG. 3B, the flat grid 206 can be disposed between the discharge wire 205 and the composition layer 401 disposed on the substrate 3. Here, from the viewpoint of making the charging potential on the surface of the composition layer 401 uniform, a distance between the surface of the composition layer 401 and the grid 206 is preferably in the range between 1 mm or more and 10 mm or less.

An electric field is generated by charging the surface of the elastic layer for a predetermined time or more, and the fillers are arranged in the thickness direction of the elastic layer. Thereafter, the elastic layer is cured by heating or the like to fix the arrangement of the fillers. The time (the time until the fillers are arranged) for which the surface of the elastic layer is charged is not particularly limited, but is for example, about 1 second to 60 seconds, and particularly about 1 second to 20 seconds.

From the viewpoint of generating an effective electrostatic interaction for the thermally conductive filler, the voltage applied to the grid 206 is preferably in the range of 0.3 kV to 3 kV, in particular, 0.6 kV to 2 kV as an absolute value. If a sign of the applied voltage is equal to a sign of a voltage applied to the wire, a direction of an electric field is reversed regardless of whether the electric field is minus or plus, but the obtained effect is the same.

(i-4) Curing Step

The composition layer is cured by heating or the like to form the elastic layer in which a position of the thermally conductive filler in the composition layer is fixed.

Figure 4:
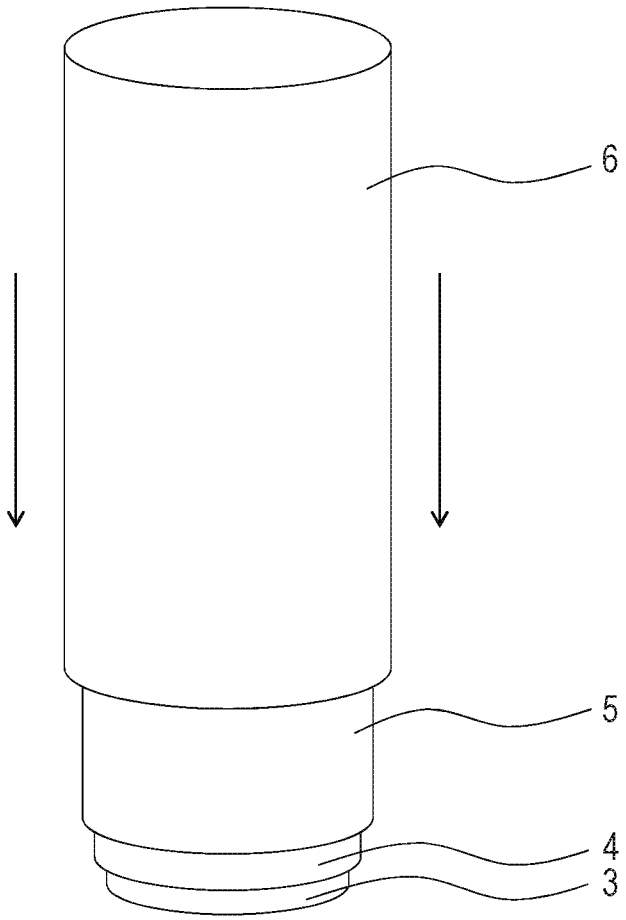
FIG. 4 is a schematic view of an example of a process of laminating surface layers.

(iii) Step of Forming Adhesive Layer on Elastic Layer (iv) Step of Forming Surface Layer on Elastic Layer FIG. 4 is a schematic view showing an example of a step of laminating a surface layer 6 on an elastic layer 4 containing silicone rubber via an adhesive layer 5 formed using an addition-curable silicone rubber adhesive. First, the addition-curable silicone rubber adhesive is applied to the surface of the elastic layer 4 formed on an outer peripheral surface of the substrate 3. In addition, a fluororesin tube for forming the surface layer 6 is coated and laminated on the outer surface thereof. An inner surface of the fluororesin tube can be subjected to sodium treatment, excimer laser treatment, ammonia treatment or the like in advance to improve the adhesion.

Although the coating method of the fluororesin tube is not particularly limited, a method for coating an addition-curable silicone rubber adhesive as a lubricant, a method for expanding a fluororesin tube from the outside and coating the fluororesin tube, and the like can be used. In addition, the excessive addition-curable silicone rubber adhesive remaining between the elastic layer 4 and the surface layer 6 made of a fluororesin can be squeezed out and removed by using a means (not shown). The thickness of the adhesive layer 5 after being squeezed out is preferably 20 μm or less from the viewpoint of thermal conductivity.

Next, the addition-curable silicone rubber adhesive can be heated for a predetermined time by a heating unit such as an electric furnace to form the adhesive layer 5 and the surface layer 6 on the elastic layer 4. In addition, the conditions such as the heating time and the heating temperature can be appropriately set according to the used adhesive and the like. The fixing member can be obtained by cutting both end parts in the width direction of the obtained member into a desired length.

(8) Heat Fixing Apparatus

A heat fixing apparatus according to the present embodiment is configured so that rotating body such as a pair of heated roller and roller, belt and roller, and belt and belt are pressure-welded with each other. The type of the heat fixing apparatus is appropriately selected in consideration of conditions such as a process speed and a size as the entire electrophotographic image forming apparatus in which the heat fixing apparatus is mounted.

In the heat fixing apparatus, a fixing nip portion N is formed by pressure-welding between a heating member and a pressure member, and a recording medium S which is an object to be heated on which an image is formed by an unfixed toner is nipped and conveyed to the fixing nip portion N. The image formed by the unfixed toner is referred to as a toner image t. Accordingly, the toner image t is heated and pressurized. As a result, the toner image t is melted and mixed, and then cooled to fix the image on the recording medium.

Hereinafter, the configuration of the heat fixing apparatus will be described with reference to a specific example of the heat fixing apparatus, but the scope and application of the present disclosure are not limited thereto.

(8-1) Heating Belt-Pressure Belt Type Heat Fixing Apparatus

Figure 5:
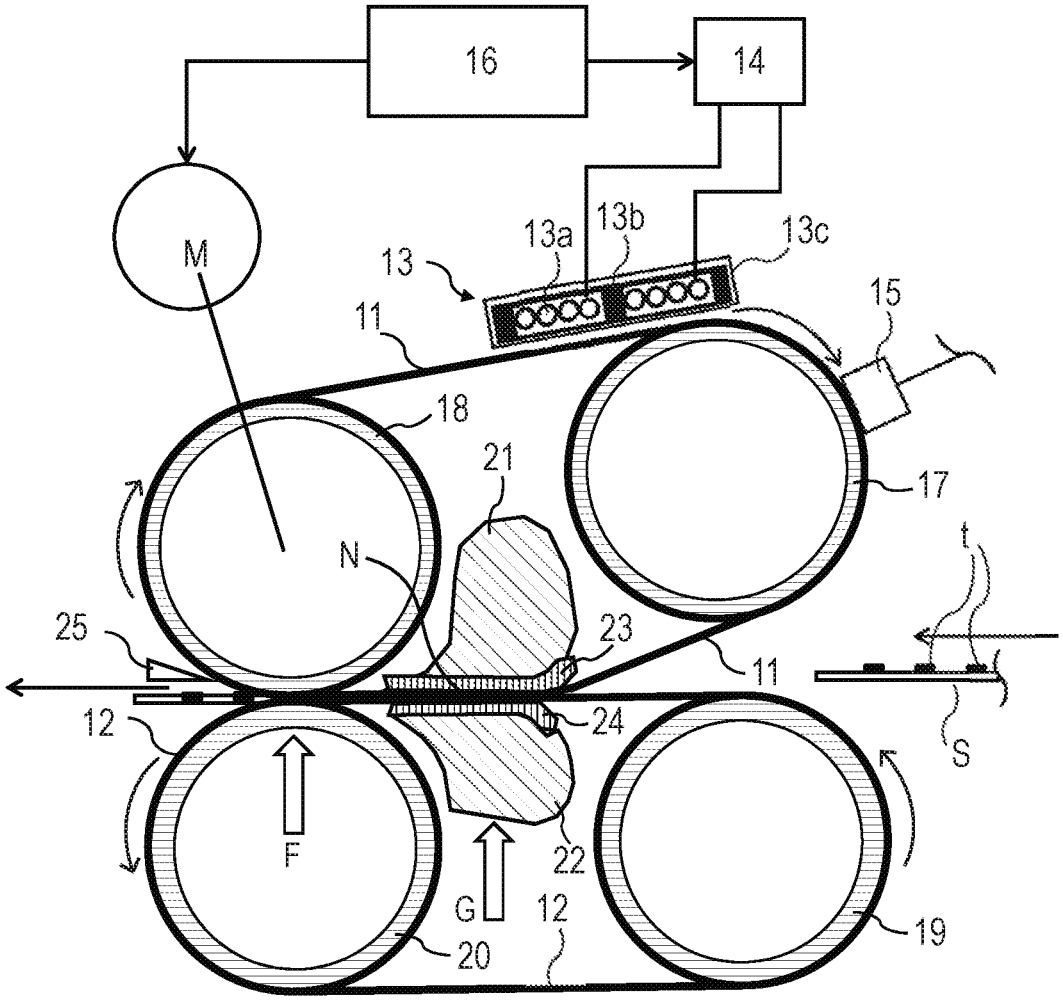
FIG. 5 is a schematic cross-sectional view of an example of a heat fixing apparatus of a heating belt-pressure belt type.

FIG. 5 shows a so-called twin-belt type heat fixing apparatus in which a pair of heating belts 11 and a rotating body such as a pressure belt 12 are pressure-welded with each other, and is a schematic cross-sectional view of an example of a heat fixing apparatus using an endless belt-shaped fixing member (fixing belt) according to the present aspect as a heating belt 11.

Here, for the heat fixing apparatus or a member constituting the heat fixing apparatus, a width direction is a direction vertical to a paper surface of FIG. 5. Regarding the heat fixing apparatus, a front surface is a surface on an introduction side of the recording medium S. Left and right refer to left or right when the apparatus is viewed from the front. A width of the belt is a belt dimension in a left-right direction when the apparatus is viewed from the front. The width of the recording medium S is the dimension of the recording medium in a direction (width direction of the belt) orthogonal to a conveyance direction. In addition, an upstream or a downstream is an upstream or a downstream with respect to the conveyance direction of the recording medium S.

The heat fixing apparatus includes the heating belt 11 and the pressure belt 12. The heating belt 11 and the pressure belt 12 are, for example, those obtained by stretching, to two rollers, the fixing belt as shown in FIG. 2A, which is provided with a flexible substrate made of metal having nickel as a main component.

As the heating unit of the heating belt 11, a heating source (induction heating member and excitation coil) which can be heated by electromagnetic induction heating having high energy efficiency is adopted. The induction heating member 13 is configured to include an induction coil 13*a*, an excitation core 13*b*, and a coil holder 13*c* for holding them. The induction coil 13*a* is disposed on a transverse E-shaped excitation core 13*b* projecting to a center and both sides of the induction coil, using a litz wire flat-wound in an oval shape. Since the excitation core 13*b* uses high permeability and low residual magnetic velocity density such as ferrite and permalloy, the loss in the induction coil 13*a* and the excitation core 13*b* can be suppressed, and the heating belt 11 can be efficiently heated.

If a high frequency current flows from the excitation circuit 14 to the induction coil 13*a* of the induction heating member 13, the substrate of the heating belt 11 inductively generates heat and the heating belt 11 is heated from the substrate side. The surface temperature of the heating belt 11 is detected by a temperature detection element 15 such as a thermistor. A signal related to the temperature of the heating belt 11 detected by the temperature detection element 15 is transmitted to a control circuit unit 16. The control circuit unit 16 controls power supplied from the excitation circuit 14 to the induction coil 13*a* so that the temperature information received from the temperature detection element 15 is maintained at a predetermined fixing temperature, thereby adjusting the temperature of the heating belt 11 to a predetermined fixing temperature.

The heating belt 11 is stretched by a roller 17 as a belt rotating member and a heating side roller 18. The roller 17 and the heating side roller 18 are each rotatably borne and supported between left and right side plates (not shown) of the apparatus.

The roller 17 is, for example, an iron hollow roller having an outer diameter of 20 mm, an inner diameter of 18 mm, and a thickness of 1 mm, and functions as a tension roller which applies tension to the heating belt 11. The heating side roller 18 is, for example, a highly slidable elastic roller in which a silicone rubber layer as an elastic layer is provided on an iron alloy core metal having an outer diameter of 20 mm and an inner diameter of 18 mm.

The heating side roller 18 receives a driving force from a driving source (motor) M as a driving roller through a driving gear train (not shown), and is rotationally driven at a predetermined speed in a clockwise direction of an arrow. By providing the heating side roller 18 with the elastic layer as described above, the driving force input to the heating side roller 18 can be favorably transmitted to the heating belt 11, and the fixing nip can be formed for securing separation of the recording medium from the heating belt 11. The heating side roller 18 has the elastic layer and thus the thermal conduction to the heating side roller is also reduced, so it is effective to shorten a warm-up time.

When the heating side roller 18 is rotationally driven, the heating belt 11 rotates with the roller 17 due to the friction between the silicone rubber surface of the heating side roller 18 and the inner surface of the heating belt 11. The arrangement or size of the roller 17 and the heating side roller 18 are selected in accordance with the size of the heating belt 11. For example, the dimensions of the roller 17 and the heating side roller 18 are selected so that the heating belt 11 having an inner diameter of 55 mm when the heating belt 11 is not mounted can be stretched.

The pressure belt 12 is stretched by a tension roller 19 as a belt rotating member and a pressure side roller 20. An inner diameter of the pressure belt when the pressure belt is not mounted is, for example, 55 mm. The tension roller 19 and the pressure side roller 20 are each rotatably borne and supported between the left and right side plates (not shown) of the apparatus.

The tension roller 19 is provided with a silicone sponge layer in order to reduce thermal conduction from the pressure belt 12 by reducing thermal conductivity in a core metal which has an outer diameter of 20 mm and a diameter of 16 mm and is made of an iron alloy. The pressure side roller 20 is, for example, a low slidable rigid roller made of an iron alloy having an outer diameter of 20 mm, an inner diameter of 16 mm, and a thickness of 2 mm. Similarly, the dimensions of the tension roller 19 and the pressure side roller 20 are selected in accordance with the dimension of the pressure belt 12.

Here, in order to form the nip portion N between the heating belt 11 and the pressure belt 12, the pressure side roller 20 is pressed toward the heating side roller 18 by applying a predetermined pressing force to both right and left ends of a rotating shaft in a direction of an arrow F by a pressure mechanism (not shown).

In addition, in order to obtain a wide nip portion N without increasing the size of the apparatus, a pressure pad is adopted. That is, the pressure pad is a fixing pad 21 as a first pressure pad which pressures the heating belt 11 toward the pressure belt 12 and a pressure pad 22 as a second pressure pad which presses the pressure belt 12 toward the heating belt 11. The fixing pad 21 and the pressure pad 22 are supported and disposed between the left and right side plates (not shown) of the apparatus. The pressure pad 22 is pressed toward the fixing pad 21 by applying a predetermined pressure in a direction of an arrow G by the pressure mechanism (not shown). The fixing pad 21 which is the first pressure pad is provided with a sliding sheet (low friction sheet) 23 which is in contact with a pad substrate and a belt. The pressure pad 22 which is the second pressure pad is also provided with a sliding sheet 24 which is in contact with the pad substrate and the belt. This is due to the problem that the grinding of the portion which is rubbed with the inner peripheral surface of the belt of the pad is increased. It is possible to prevent the grinding of the pad and reduce the sliding resistance by interposing the sliding sheets 23 and 24 between the belt and the pad substrate, and as a result, it is possible to ensure good belt running performance and belt durability.

In addition, the heating belt is provided with a non-contact anti-static brush (not shown), and the pressure belt is provided with a contact anti-static brush (not shown).

The control circuit unit 16 drives a motor M at least at the time of performing the image formation. Therefore, the heating side roller 18 is rotationally driven, and the heating belt 11 is rotationally driven in the same direction. The pressure belt 12 rotates following the heating belt 11. In this case, the lowermost part of the fixing nip is constituted so as to be conveyed while being nipped between the heating belt 11 and the pressure belt 12 by the roller pair 18 and 20, so the slip of the belt can be prevented. The lowermost part of the fixing nip is a part where the pressure distribution (recording medium conveyance direction) at the fixing nip is maximum.

The recording medium S having the unfixed toner image t is conveyed to the nip portion N between the heating belt 11 and the pressure belt 12 in the state in which the heating belt 11 is raised and maintained (referred to as temperature control) to a predetermined fixing temperature. The recording medium S is introduced so that the surface carrying the unfixed toner image t is directed to the heating belt 11 side. Then, the unfixed toner image t of the recording medium S is nipped and conveyed while being in close contact with the outer peripheral surface of the heating belt 11, and thus is fixed on the surface of the recording medium S by being applied with heat from the heating belt 11 and being applied with the pressing force. At this time, the heat from the heated substrate of the heating belt 11 is efficiently transported toward the recording medium S through the elastic layer whose thermal conduction direction is adjusted. Thereafter, the recording medium S is separated from the heating belt by a separating member 25 and conveyed.

As described above, in the heat fixing apparatus using the fixing belt according to this aspect as the heating belt 11, the heat generated in the substrate by induction heating tends to flow in a thickness direction rather than the in-plane direction of the elastic layer. Therefore, at the fixing nip portion, heat can be efficiently supplied to the recording medium S and the toner.

(8-2) Heating Belt-Pressure Roller Type Heat Fixing Apparatus

Figure 6:
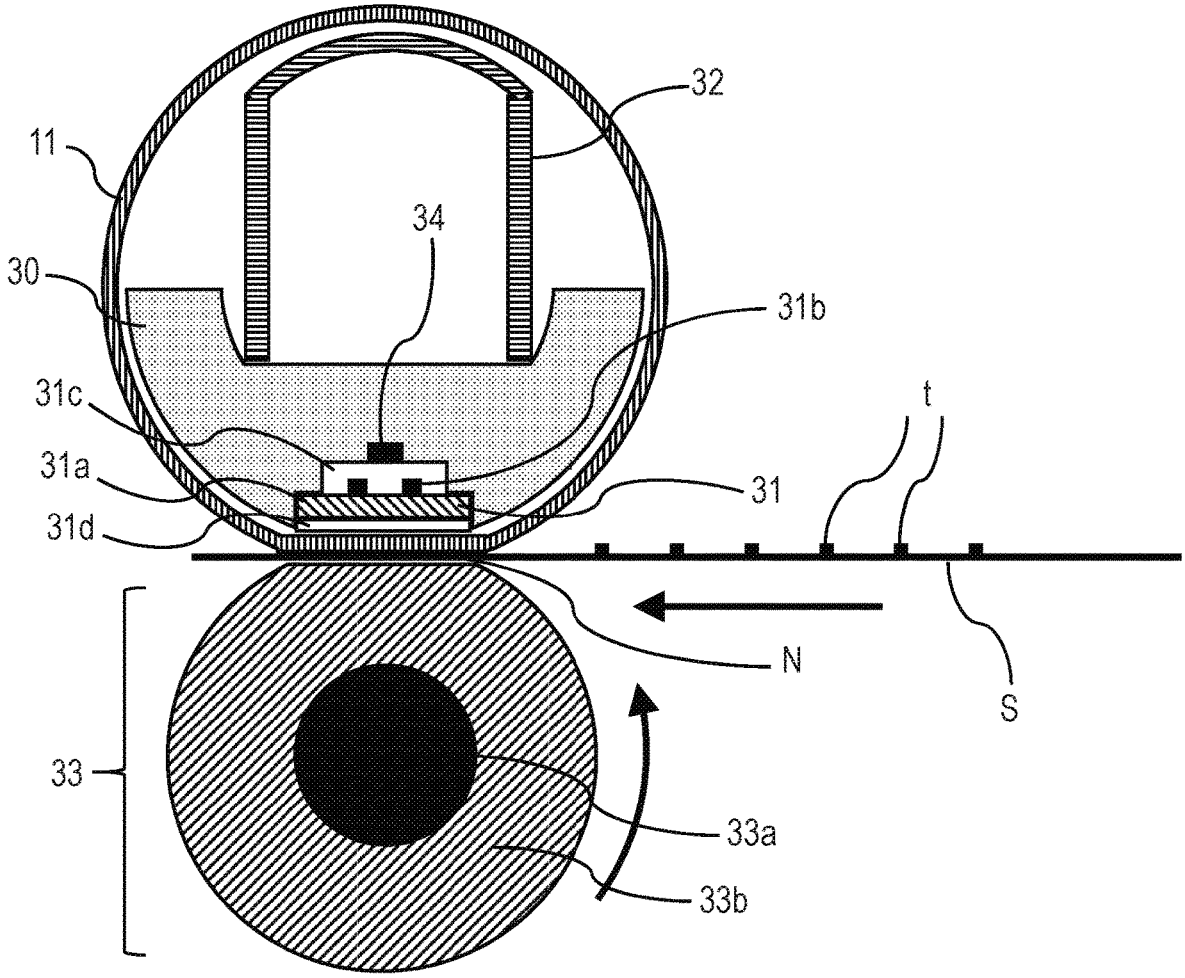
FIG. 6 is a schematic cross-sectional view of an example of a heat fixing apparatus of a heating belt-pressure roller type.

FIG. 6 is a schematic view showing an example of a heating belt-pressure roller type heat fixing apparatus using a ceramic heater as a heating body. A fixing belt according to this aspect is used as a heating belt.

In FIG. 6, reference numeral 11 is a cylindrical or endless belt-shaped heating belt, and the fixing member according to the present embodiment can be used. There is a heat resistant and heat insulating belt guide 30 for holding the heating belt 11, and a ceramic heater 31 which heats the heating belt 11 at a position (approximately a center of a lower surface of a belt guide 30) in contact with the heating belt 11 is fitted in a groove portion formed along a longitudinal direction of a guide to be fixedly supported. The heating belt 11 is loosely fitted onto an outside of the belt guide 30. In addition, a rigid stay 32 for pressurization is inserted into an inside of the belt guide 30.

On the other hand, a pressure roller 33 is disposed opposite to the heating belt 11. The pressure roller 33, in this example, an elastic pressure roller, that is, a core metal 33*a* provided with an elastic layer 33*b* made of silicone rubber and thus its hardness is lowered, and both end parts of the core metal 33*a* are rotatably borne and disposed between front and rear chassis side plates (not shown) of the apparatus. In addition, the elastic pressure roller is coated with a tetrafluoroethylene/perfluoroalkylether copolymer (PFA) tube in order to improve surface property.

A pressing force is applied to the rigid stay 32 for pressurization by compressing pressure springs (not shown) between both end parts of the rigid stay 32 for pressurization and a spring receiving member (not shown) on a side of the apparatus chassis, respectively. As a result, a lower surface of the ceramic heater 31 disposed on a lower surface of the belt guide 30 made of a heat-resistant resin and an upper surface of the pressure roller 33 are pressed against each other with the heating belt 11 provided therebetween to form the fixing nip portion N.

The pressure roller 33 is rotationally driven in a counterclockwise direction as indicated by an arrow by a driving unit (not shown). A rotational force is applied to the heating belt 11 by the frictional force between the pressure roller 33 and the outer surface of the heating belt 11 by the rotation driving of the pressure roller 33, and the heating belt 11 rotates outward of the belt guide 30 at a peripheral speed substantially corresponding to a rotational peripheral speed of the pressure roller 33 in a clockwise direction while the heating belt 11 slides by bringing an inner surface of the heating belt 11 to be in close contact with the lower surface of the ceramic heater 31 at the fixing nip portion N (pressure roller driving scheme).

The rotation of the pressure roller 33 is started based on a print start signal, and further, heat-up of the ceramic heater 31 is started. At the moment that the rotational peripheral speed of the heating belt 11 by the rotation of the pressure roller 33 makes steady and a temperature of a temperature detection element 34 provided on the upper surface of the ceramic heater rises to a predetermined temperature, for example, 180° C., the recording medium S carrying the unfixed toner image t as a material to be heated between the heating belt 11 and the pressure roller 33 at the fixing nip portion N is introduced by setting the toner image carrying surface side as the heating belt 11 side. The recording medium S is in close contact with the lower surface of the ceramic heater 31 via the heating belt 11 at the fixing nip portion N and moves through the fixing nip portion N together with the heating belt 11. While the recording medium S moves through the fixing nip portion N, the heat of the heating belt 11 is applied to the recording medium S, and the toner image t is heated and fixed on the surface of the recording medium S. The recording medium S which has passed through the fixing nip portion N is separated from the outer surface of the heating belt 11 and conveyed.

The ceramic heater 31 as the heating body is a rectangular linear heating body having a low heat capacity, in which a longitudinal direction of the heating body is a direction orthogonal to the moving direction of the heating belt 11 and the recording medium S. The ceramic heater 31 preferably includes a heater substrate 31*a*, a heat generating layer 31*b* provided on the surface of the heater substrate 31*a* along a longitudinal direction thereof, a protective layer 31*c* provided thereon, and a sliding member 31*d* as basic components. Here, the heater substrate 31*a* can be made of aluminum nitride or the like. The heat generating layer 31*b* can be formed, for example, by coating an electrically resistive material such as silver/palladium (Ag/Pd) to a thickness of about 10 μm and a width of 1 to 5 mm by screen printing or the like. The protective layer 31*c* can be made of glass, a fluororesin, or the like. It should be noted that the ceramic heater used for the heat fixing apparatus is not limited thereto.

By supplying electricity between both end parts of the heat generating layer 31*b* of the ceramic heater 31, the heat generating layer 31*b* generates heat, and the temperature of the ceramic heater 31 rapidly rises. The ceramic heater 31 is fixedly supported by fitting the protective layer 31*c* side upward into the groove formed at substantially the central part of the lower surface of the belt guide 30 along the longitudinal direction of the guide. The surface of the sliding member 31*d* of the ceramic heater 31 and the inner surface of the heating belt 11 make sliding contact with each other at the fixing nip portion N which is in contact with the heating belt 11.

As described above, the heat fixing apparatus using the fixing belt according to the present aspect as the heating belt 11 tends to allow the heat supplied to the heating belt by the heater disposed in contact with the inner peripheral surface of the heating belt to flow in the thickness direction rather than in the in-plane direction of the elastic layer. Therefore, at the fixing nip portion N, the heat can be efficiently supplied to the recording medium S and the toner.

According to one aspect of the present disclosure, it is possible to obtain the fixing member for the heat fixing apparatus capable of further improving the utilization efficiency of heat to thermally fix the unfixed toner. In addition, according to another aspect of the present disclosure, it is possible to obtain the heat fixing apparatus which contributes to the more efficient formation of the electrophotographic image.

EXAMPLE

Hereinafter, the present disclosure will be described in more detail with reference to Examples.

Example 1

(1) Preparation of Addition-Curable Liquid Silicone Rubber Composition

First, as a Component (a), 100 parts by mass of organopolysiloxane (trade name: DMS-V41, manufactured by Gelest Inc., viscosity: 10000 $mm^2/s$) having a vinyl group which is an unsaturated aliphatic group only at both molecular chain terminals and a methyl group as a non-substituted hydrocarbon group was prepared.

Next, 307.4 parts by mass of magnesium oxide powder (trade name: SL-WR, manufactured by KONOSHIMA Co., Ltd.) as a filler was added to the Component (a) to obtain Mixture 1.

Subsequently, 0.2 parts by mass of 1-ethynyl-1-cyclohexanol (manufactured by Tokyo Chemical Industry Co., Ltd.) as a curing retarder dissolved in a toluene of the same weight was added to Mixture 1 to obtain Mixture 2.

Next, as a Component (c), 0.1 parts by mass of hydrosilylation catalyst (platinum catalyst: mixture of 1,3-divinyltetramethyldisiloxane platinum complex, 1,3-divinyltetramethyldisiloxane, and 2-propanol) was added to Mixture 2 to obtain Mixture 3.

In addition, as a Component (b), 1.3 parts by mass of organopolysiloxane having a linear siloxane skeleton and having an active hydrogen group bonded to silicon only in the side chain (trade name: HMS-301, manufactured by Gelest Inc., viscosity: 30 $mm^2/s$) was measured. The measured organopolysiloxane was added to Mixture 3 and sufficiently mixed to obtain an addition-curable liquid silicone rubber composition containing 46% by volume of magnesium oxide powder.

(2) Production of Fixing Belt

As a substrate, a nickel electroformed endless sleeve having an inner diameter of 55 mm, a width of 420 mm, and a thickness of 65 μm was prepared. During a series of production steps, the endless sleeve was handled by inserting a core thereinto.

A primer (trade name: DY39-051A/B, manufactured by Dow Corning Toray Co., Ltd.) was substantially uniformly applied onto an outer peripheral surface of the substrate so that a dry weight thereof is 50 mg, and after a solvent is dried, baking processing was performed for 30 minutes by an electric furnace set to 160° C.

The addition-curable liquid silicone rubber composition was applied onto the substrate which is subjected to primer treatment by a ring coating method to form a composition layer having a thickness of 450 μm.

Next, as shown in FIGS. 3A and 3B, corona chargers 2 were disposed opposite to each other along a longitudinal direction of the substrate having the composition layer. Specifically, the longitudinal direction of the corona charger 2 was disposed substantially parallel to the longitudinal direction of the substrate, and the surface of the composition layer was charged while rotating the substrate at 100 rpm. The conditions were that a current supplied to a discharge wire of the corona charger was −150 μA, a grid electrode potential was −950 V, and a charging time was 20 seconds. A distance between the grid electrode and the surface of the composition layer was 4 mm, and a tungsten wire having a diameter of 50 μm was used as the discharge wire. In addition, as the substrate of the grid, one in which a plurality of through-holes are formed by performing etching processing on a sheet metal on a thin plate which is made of austenitic stainless steel (SUS304) and has a thickness of about 0.03 mm was used.

The substrate having the composition layer charged on the surface is put into the electric furnace and heated at a temperature of 160° C. for 1 minute (primary curing), and subsequently heated at a temperature of 200° C. for 30 minutes (secondary curing) to cure the composition layer, thereby forming the elastic layer.

The addition-curable silicone rubber adhesive (trade name: SE1819CV A/B, manufactured by Dow Corning Toray Co., Ltd.) was substantially uniformly applied onto the surface of the elastic layer so as to have a thickness of about 20 μm. A fluororesin tube (trade name: NSE, manufactured by Gunze LIMITED) having an inner diameter of 52 mm and a thickness of 40 μm was laminated on the surface of the elastic layer while a diameter thereof is expanded. Next, the excess adhesive was squeezed out from between the elastic layer and the fluororesin tube to form the adhesive layer having a thickness of 5 μm. The adhesive layer was heated at a temperature of 200° C. for 1 hour to cure the adhesive layer, and the fluororesin tube was fixed on the elastic layer by the adhesive layer. Finally, the substrate and the fluororesin tube, the adhesive layer, and both end parts of the cured composition layer on the substrate were cut to obtain a fixing belt having a width of 368 mm.

(3) Characteristic Evaluation of Elastic Layer of Fixing Belt

After the substrate is subjected to the primer treatment by the same method as the method for producing a fixing belt described above, the composition layer having a thickness of 450 μm was formed by the ring coating method, charged using the corona charger, and then cured by heating, thereby obtaining an elastic layer sample.

(3-1) Thermal Conductivity of Elastic Layer in Thickness Direction

The thermal conductivity λnd of the elastic layer in the thickness direction was calculated from the following equation.

$$\lambda nd = \alpha_{nd} \times C_p \times \rho$$

In the equation, λnd is a thermal conductivity (W/(m·K)) of the elastic layer in the thickness direction, $\pi_{nd}$ is a thermal diffusivity ($m^2/s$) of the elastic layer in the thickness direction, $C_p$ is a constant pressure specific heat (J/(kg)·K)), and ρ is the density ($kg/m^3$). Here, the values of the thermal diffusivity $\alpha_{nd}$ in the thickness direction, the constant pressure specific heat $C_p$, and the density ρ were determined by the following method.

Thermal Diffusivity $\alpha_{nd}$

The thermal diffusivity and of the elastic layer in the thickness direction was measured at a room temperature (25° C.) using a periodical heating method thermal property measurement apparatus (trade name: FTC-1, manufactured by ADVANCE RIKO, Inc.). From the elastic layer sample, a sample piece having an area of 8×12 mm was cut off with a cutter, and a total of five sample pieces were produced and pinched with two polyimide sheets (total thickness of two sheets=17.9 μm, $\alpha=9.78\times10^{-8}$ $m^2/s$), and then a thickness of each sample piece was measured. Next, for each sample piece, measurement was performed a total of five times within a frequency range of 0.5 Hz to 5 Hz, and the average value ($m^2/s$) was obtained.

Constant Pressure Specific Heat $C_P$

The constant pressure specific heat of the elastic layer was measured using a differential scanning calorimeter (trade name: DSC823e, manufactured by Mettler Toledo).

Specifically, an aluminum pan was used as a sample pan and a reference pan. First, as a blank measurement, the measurement was performed with a program which maintains both pans at a constant temperature of 15° C. for 10 minutes and then raises a temperature of the pans rises to 215° C. at a temperature raising rate of 10° C./minute, and furthermore, maintains both pans at a constant temperature of 215° C. for 10 minutes. Next, 10 mg of synthetic sapphire having a known constant pressure specific heat was used as a reference material, and measurement was performed using the same program. Next, 10 mg of measurement sample which is the same amount as the synthetic sapphire as the reference material was cut out from the elastic layer sample, and then set in the sample pan, and the measurement was performed with the same program. The measurement results were analyzed using a specific heat analysis software attached to the differential scanning calorimeter, and the constant pressure specific heat Cr at 25° C. was calculated from the average value of the measurement results conducted five times.

Density ρ

The density of the elastic layer was measured using a dry automatic densitometer (trade name: AccuPic 1330-01, manufactured by Shimadzu Corporation).

Specifically, using a sample cell of 10 $cm^3$, a sample piece was cut out from the elastic layer sample so as to satisfy approximately 80% of the cell volume, and the mass of this sample piece was measured and then put into the sample cell. The sample cell was set in a measurement unit in the apparatus, helium was used as a gas for measurement, and volume measurement was performed ten times after gas replacement. The density of the elastic layer was calculated from the mass of the sample piece and the measured volume for each time, and the average value was obtained.

As a result of calculating the thermal conductivity λnd of the elastic layer in the thickness direction from the constant pressure specific heat $C_p$ (J/(kd·K)) and the density ρ ((kg/$m^3$) of the elastic layer, and the measured thermal diffusivity and ($m^2$/s), the calculated value of the thermal conductivity λnd was 1.44 W/(m·K).

(3-2) Thermal Conductivity of Elastic Layer in Surface Direction

The thermal conductivity λmd of the elastic layer in the width direction and the thermal conductivity λtd of the elastic layer in the circumferential direction were calculated from the following equations.

$$\lambda md=\alpha_{md}\times C_p\times\rho$$

$$\lambda td=\alpha_{td}\times C_p\times\rho$$

In the Equation, $\alpha_{md}$ is the thermal diffusivity in the width direction ($m^2$/s), ma is the thermal diffusivity in the circumferential direction ($m^2$/s), $C_p$ is the constant pressure specific heat (J/(kd·K), and ρ is the density (kg/$m^3$).

Here, the constant pressure specific heat $C_p$ and the density ρ were the values obtained by the above method, and the thermal diffusivity $\alpha_{md}$ in the width direction and the thermal diffusivity $\alpha_{td}$ in the circumferential direction were obtained by the following method.

It was measured at a room temperature (25° C.) using a light AC method thermal diffusivity measurement apparatus (trade name: LaserPlT, manufactured by ADVANCE RIKO, Inc.). First, a sample piece of 5×30 mm was cut off with a cutter so that the width direction or the circumferential direction of the elastic layer sample was 30 mm. Next, a black body paint (trade name: JSC-3, manufactured by Japan Sensor Corporation) was applied onto the surface of the sample piece, and was baked for 20 minutes by the electric furnace set at 150° C. to produce a sample. Each sample was measured twice under the following conditions, and the average value was obtained. The measurement conditions are as follows: a room temperature, in vacuum, total time (total measurement time) of 800 sec, sampling 2, period (1/frequency) 5, rate (moving speed of a sample mounting base) of 10 μm/s, and level (moving distance of a sample mounting base) of 3000 μm.

The thermal conductivity λmd of the elastic layer in the width direction and the thermal conductivity λtd of the elastic layer in the circumferential direction were calculated from the constant pressure specific heat $C_p$ (J/(kd·K)) and the density ρ (kg/$m^3$) of the elastic layer and the measured thermal diffusivities $\alpha_{md}$ ($m^2$/s) and $\alpha_{td}$ ($m^2$/s). As a result, λmd=1.32 W/(m·K) and λtd=1.23 W/(m·K).

(3-3) Tensile Elastic Modulus of Elastic Layer

A tensile elastic modulus of an elastic layer was measured to confirm that the elastic layer has low hardness. Specifically, an elastic layer sample was cut out by a punching die (JIS K6251:2017, tensile dumbbell-shaped 8), and a thickness of a sample piece in the vicinity of the center which is a measurement location was measured. Next, the cut-out sample pieces were tested at a tensile speed of 200 mm/min and a room temperature using a tensile tester (apparatus name: Strograph EII-L1, manufactured by Toyo Seiki Seisaku-sho, Ltd.). It is to be noted that the tensile elastic modulus is indicated by a slope when measurement data are linearly approximated within the range in which the strain is 0 to 10% by creating a graph in which a strain of a sample piece is indicated on an abscissa and a tensile stress is indicated on an ordinate based on the measurement results. As a result, the tensile elastic modulus of the elastic layer was 0.80 MPa.

(4) Evaluation of Fixing Belt

<Fixability Evaluation>

The fixing belt thus obtained was incorporated into a heat fixing apparatus of an electrophotographic copying machine (trade name: imagePRESS C850, manufactured by Canon Inc.). Then, the heat fixing apparatus was mounted on the copying machine. Using this copying machine, a fixing temperature is set to be lower than a standard fixing temperature, and a solid cyan image was formed on a thick paper (trade name: UPM Finesse gloss 300 g/$m^2$, UPM) having a basis weight of 300 g/$m^2$.

Specifically, the fixing temperature of the heat fixing apparatus was adjusted from 195° C. to 185° C. which is the standard fixing temperature in the copying machine to continuously form five solid cyan images and measure an image density of a fifth solid image. Next, a toner surface of the solid image was rubbed three times in the same direction as the toner surface in lens-cleaning paper to which a load of 4.9 kPa (50 g/$cm^2$) is applied and the image density after the rubbing was measured. Then, when a reduction rate (=[difference in image densities before and after rubbing/image density before rubbing]×100) of the image densities before and after the rubbing is less than 5%, it was determined that the toner is fixed to the thick paper. The results were evaluated based on the following criteria. The image density was measured using a reflection densitometer (manufactured by Macbeth).

In addition, the state in which the toner is fixed to the thick paper was evaluated in the same manner as described above except that the fixing temperature was adjusted to 180° C.

Rank A: The toner was fixed to the thick paper at a fixing temperature of 180° C.

Rank B: The toner was fixed to the thick paper at a fixing temperature of 185° C.

Rank C: The toner was not fixed to the thick paper at a fixing temperature of 185° C.

<Image Quality Evaluation>

The fifth solid image produced in the above fixability evaluation was visually observed, and the presence or absence of gloss unevenness and the degree thereof were evaluated based on the following criteria.

Rank A: Extremely excellent because there is no gloss unevenness.

Rank B: Excellent because there is no gloss unevenness.

Rank C: There was slight gloss unevenness.

<Durability Evaluation>

In the state in which the fixing temperature is set to the standard fixing temperature (195° C.), a continuous formation of a cyan solid image on A4 size plain paper was performed, and the number of sheets at the time of breakage or plastic deformation of the elastic layer of the fixing belt was recorded and evaluated based on the following criteria. In the case where the breakage or the plastic deformation did not occur in the elastic layer of the fixing belt even when the number of sheets of images reached 740,000, the image formation was stopped after an image of 740,000 sheets is formed.

Rank A: No breakage or plastic deformation was recognized in the elastic layer of the fixing belt even by forming an image of 740,000 sheets.

Rank B: No breakage or plastic deformation occurred in the elastic layer of the fixing belt even after forming an image of 300,000 sheets, but the breakage or the plastic deformation occurred in the elastic layer of the fixing belt after forming an image of 740,000 sheets.

Rank C: No breakage or plastic deformation occurred in the elastic layer of the fixing belt even after forming an image of 100,000 sheets, but the breakage or the plastic deformation occurred in the elastic layer of the fixing belt after forming an image of 300,000 sheets.

Example 2

An addition-curable liquid silicone rubber composition containing 46% by volume of magnesium oxide powder was obtained in the same manner as in Example 1 except that the materials shown in Table 1 were used as the Component (a), the Component (b), and the filler.

A fixing belt according to Example 2 was produced and evaluated in the same manner as in Example 1 except that the addition-curable liquid silicone rubber composition was used.

TABLE 1

| | Example 2 | |
|---|---|---|
| | Material Name | Blending amount (part by mass) |
| Component (a) | Organopolysiloxane "Trade name: DMS-V35; manufactured by Gelest Inc., Viscosity: 5000 $mm^2/s$" | 100.0 |
| Component (b) | Organopolysiloxane "Trade name: HMS-301; manufactured by Gelest Inc. Viscosity: 30 $mm^2/s$" | 1.2 |

TABLE 1-continued

| | Example 2 | |
|---|---|---|
| | Material Name | Blending amount (part by mass) |
| Filler | Magnesium oxide "Trade name: SL-WR; manufactured by KONOSHIMA Co., Ltd." | 287.3 |
| | Magnesium oxide "trade name: PSF-WR; manufactured by KONOSHIMA Co., Ltd." | 20.0 |

Example 3

An addition-curable liquid silicone rubber composition containing 46% by volume of magnesium oxide powder was obtained in the same manner as in Example 1 except that a blending amount of the Component (b) was set to 1.5 parts by mass. A fixing belt according to Example 3 was produced and evaluated in the same manner as in Example 1 except that the addition-curable liquid silicone rubber composition was used.

Example 4

An addition-curable liquid silicone rubber composition containing 46% by volume of magnesium oxide powder was obtained in the same manner as in Example 1 except that a blending amount of the Component (b) was set to 1.05 parts by mass. A fixing belt according to Example 4 was produced and evaluated in the same manner as in Example 1 except that the addition-curable liquid silicone rubber composition was used.

Comparative Examples 1 and 2

Fixing belts according to Comparative Examples 1 and 2 were produced and evaluated in the same manner as Example 1 or 2 except that the surface of the composition layer was not charged.

Comparative Example 3

An addition-curable liquid silicone rubber composition containing 40% by volume of magnesium oxide powder was obtained in the same manner as in Example 1 except that a filler amount was set to 240.5 parts by mass. A fixing belt according to Comparative Example 3 was produced and evaluated in the same manner as in Example 1 except that the addition-curable liquid silicone rubber composition was used.

The results of the above Examples 1 to 4 and Comparative Examples 1 to 3 are shown in Table 2.

TABLE 2

| | | Filler | | Thermal conductivity of elastic layer (W/(m · K)) | | | Elastic modulus of elastic layer | Fixing belt evaluation rank | | |
|---|---|---|---|---|---|---|---|---|---|---|
| | | Type | Volume ratio (%) | λnd | λmd | λtd | (Mpa) | Fixability | Image quality | Durability |
| Example | 1 | Magnesium oxide | 46 | 1.44 | 1.32 | 1.23 | 0.80 | B | B | A |
| | 2 | " | 46 | 1.60 | 1.54 | 1.43 | 0.52 | A | B | B |
| | 3 | " | 46 | 1.45 | 1.33 | 1.24 | 1.23 | B | C | A |
| | 4 | " | 46 | 1.43 | 1.31 | 1.22 | 0.18 | B | A | C |
| Comparative Example | 1 | " | 46 | 1.18 | 1.39 | 1.36 | 0.75 | C | B | A |
| | 2 | " | 46 | 1.36 | 1.46 | 1.48 | 0.48 | C | B | B |
| | 3 | " | 40 | 1.27 | 1.15 | 1.02 | 0.77 | C | B | A |

[Evaluation Results]

Hereinafter, evaluation results of Examples and Comparative Examples shown in Table 1 will be described. In Examples 1 to 4, λnd is 1.30 W/(m·K) or more, and λnd>λmd>λtd is satisfied, and the fixing belt has an excellent heat supplying capability, so that the fixability was good. In particular, Example 2 in which λnd was high was excellent in fixability.

On the other hand, the fixing belts according to Comparative Examples 1 and 2 do not satisfy the relationship of λnd>λmd>λtd, and the heat supplying capability of the fixing belt is relatively low, and as a result, the fixability was inferior compared to Examples when the fixing temperature is lowered.

In Comparative Example 3, since λnd is less than 1.30 W/(m·K) and the thermal conductivity in the thickness direction is low, the heat supply capability of the fixing belt is low, and the fixability was inferior compared to Examples when the fixing temperature is lowered.

In addition, the fixing belts according to Examples 1, 2 and 4 were particularly excellent in the image quality evaluation result. The elastic layers of these fixing belts have an elastic modulus of 1.20 MPa or less (about 60° or less in Asker C hardness based on JIS K 7312-1996), and the surface of the fixing belt follows the irregularities of the paper fiber well, and as a result, it is considered that the softening and melting unevenness of the toner hardly occur.

In addition, since the elastic modulus of the elastic layer is 0.20 MPa or more, the breakage or the plastic deformation of the elastic layer is not recognized even if the fixing belt according to Examples 1 to 3 is used for a long period of time, the fixing belt had good durability.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-109672, filed Jun. 7, 2018, which is hereby incorporated by reference herein in its entirety.

What is claimed is:

1. A fixing member having an endless belt shape, the fixing member comprising a substrate and an elastic layer on the substrate, wherein the elastic layer includes silicone rubber and a filler dispersed in the silicone rubber, and when a thermal conductivity of the elastic layer in a thickness direction is defined as λnd, a thermal conductivity of the elastic layer in a circumferential direction is defined as λtd, and a thermal conductivity of the elastic layer in a width direction is defined as λmd, λnd is 1.30 W/(m·K) or more, and λnd, λtd, and λmd satisfy a relationship shown by the following Expression (a), Expression (a): λnd>λmd>λtd.

2. The fixing member according to claim 1, wherein λnd and λtd satisfy a relationship shown by the following Expression (b), Expression (b): λnd×0.9≥λtd.

3. The fixing member according to claim 1, wherein a ratio of a total volume of the filler in the elastic layer to a volume of the elastic layer is 30% or more and 60% or less.

4. The fixing member according to claim 1, wherein the filler is at least one selected from the group consisting of alumina, zinc oxide, metallic silicon, silicon carbide, and magnesium oxide.

5. The fixing member according to claim 1, wherein the elastic layer has an elastic modulus of 0.20 MPa or more and 1.20 MPa or less.

6. A heat fixing apparatus comprising a heating member and a pressure member disposed opposite to the heating member, wherein the heating member is the fixing member having an endless belt shape, the fixing member includes a substrate and an elastic layer on the substrate, the elastic layer includes silicone rubber and a filler dispersed in the silicone rubber, and when a thermal conductivity of the elastic layer in a thickness direction is defined as λnd, a thermal conductivity of the elastic layer in a circumferential direction is defined as λtd, and a thermal conductivity of the elastic layer in a width direction is defined as λmd, λnd is 1.30 W/(m·K) or more, and λnd, λtd, and λmd satisfy a relationship shown by the following Expression (a), Expression (a): $\lambda nd>\lambda md>\lambda td$.

7. The heat fixing apparatus according to claim 6 further comprising a heating unit which heats the substrate of the fixing member.

8. The heat fixing apparatus according to claim 7, wherein the heating unit is an induction heating unit, and the substrate of the fixing member is a member which is heated by induction heating.

9. The heat fixing apparatus according to claim 8, wherein the substrate includes at least one selected from the group consisting of nickel, copper, iron, and aluminum.

10. The heat fixing apparatus according to claim 7, wherein the heating unit is a heater which heats the substrate.

11. The heat fixing apparatus according to claim 10, wherein the heater is disposed in contact with an inner peripheral surface of the substrate of the fixing member.

* * * * *